United States Patent [19]

Gerke et al.

[11] Patent Number: 4,615,576

[45] Date of Patent: Oct. 7, 1986

[54] TERMINAL STRIP HAVING U-SHAPED LSA-PLUS TERMINALS

[75] Inventors: Dieter Gerke; Manfred Müller, both of Berlin, Fed. Rep. of Germany

[73] Assignee: Krone GmbH, Berlin, Fed. Rep. of Germany

[21] Appl. No.: 593,131

[22] Filed: Mar. 26, 1984

[30] Foreign Application Priority Data

Apr. 9, 1983 [DE] Fed. Rep. of Germany ..... 3312754

[51] Int. Cl.[4] ..... H01R 4/24

[52] U.S. Cl. ..... 339/97 P

[58] Field of Search ..... 339/97 R, 97 P, 98, 339/99 R

[56] References Cited

U.S. PATENT DOCUMENTS 4,163,596 8/1979 Austa et al. ..... 339/97 P
4,171,857 10/1979 Forberg et al. ..... 339/97 P
4,279,460 7/1981 Forberg ..... 339/97 P
4,283,103 8/1981 Forberg et al. ..... 339/97 P

FOREIGN PATENT DOCUMENTS 41596 3/1981 European Pat. Off. .
2941029 5/1980 Fed. Rep. of Germany .
2804478 11/1982 Fed. Rep. of Germany .
2725551 11/1983 Fed. Rep. of Germany .

*Primary Examiner*—Joseph H. McGlynn
*Attorney, Agent, or Firm*—Baker, Maxham & Jester

[57] ABSTRACT

The subject matter of the instant invention is formed by U-shaped, solderless, non-screwed and stripping-free, LSA-PLUS terminals (2, 2*a*) adapted to be tandem-mounted in longitudinal direction in a terminal strip (1). The terminals are disposed at a relative offset of 180° so that two respective adjacent U-shaped terminals (2, 2*a*), when viewed from the top, form generally an either X-shape (3) or an O-shape (4).

1 Claim, 5 Drawing Figures

TERMINAL STRIP HAVING U-SHAPED LSA-PLUS TERMINALS

BACKGROUND OF THE INVENTION

The invention relates to a terminal strip, made of insulative material, for connecting insulated wires each to a solderless, non-screwed, stripping-free terminal having a polytropic air gap, the terminal being formed of leaf-shaped resilient contact material including a slot. The main portion of the slot adjoins an enlarged insertion opening and is defined by sharp edges, the slot having a width which is smaller than the thickness of the metallic core of the wire, so that upon urging of the wire into the slot the wire insulation is severed and contact is made between the wire and the terminal. The terminal strip comprises a plurality of such terminals mounted in tandem in the longitudinal direction. For reference purposes, the terminals described above are referred to as LSA-PLUS terminals. The LSA-PLUS technique was developed by the assignee of the present invention. The terminology is derived from the German word "Lot-, Schraub- und Abisolierfrei," which means solderless, non-screwed and stripping-free, and "Polytropem Luftspalt," meaning polytrapic air gap. This is explained fully in commonly known U.S. Pat. No. 4,452,502 and the terms "LSA" and "PLUS" are employed in commonly owned U.S. Pat. No. 4,405,187.

From U.S. Pat. No. 4,283,103 a terminal strip including Z-shaped LSA-PLUS terminals has been known. The Z-shaped LSA-PLUS terminals are mounted in tandem in the longitudinal direction. These LSA-PLUS terminals comprise two upright leaf-spring arms disposed at an angle of 45° which define a slot into which the respective wire is urged.

In the inserted condition of the wire the two arms of each of the leaf springs are deflected out of their original plane relative to each other (torsional effect), so that these arms sever the wire insulation at offset locations and contact the wire at a respective one of the diagonally opposite inner edges of the two arms.

On account of this torsional effect forces are transferred to the terminal strip.

In the arrangement shown in U.S. Pat. No. 4,283,103 all of the forces of the Z-shaped LSA-PLUS terminals are effective in the same direction and therefore exhibit an additive effect. Thus, a large number of wires connected to the terminal strip create a relatively large cumulative torque on the strip, tending to twist it in a clockwise or counter-clockwise direction. This can have adverse effects on the apparatus to which the strip is mounted, or on the mutual connecting or mounting means.

U-shaped LSA-PLUS terminals are shown in U.S. Pat. No. 4,171,857. From this patent it is clear that all of these terminals in the terminal strip are oriented in the same direction.

SUMMARY OF THE INVENTION

It is the object of the instant invention, in connection with a terminal strip of the type shown in the above patents to mount U-shaped LSA-PLUS terminals in the terminal strip in such a way that the forces created due to the termination of wires at the individual terminals cancel each other. In this way the introduction of cumulative external forces into the terminal strip is avoided.

In accordance with the invention the above-specified object is solved in that the LSA-PLUS terminals, which are mounted in tandem in longitudinal direction in the terminal strip, are U-shaped and are alternately disposed at a rotated orientation of 180° relative to each other so that two adjacent U-shaped LSA-PLUS terminals, when viewed from above, are of X- or O-shaped configuration. The X- and O-shaped configuration thus alternate throughout the length of the terminal strip. Stated another way, each terminal is the mirror image of each adjacent terminal throughout the length of the terminal strip.

In this way the torsional effects created by the termination of longitudinal adjacent wires cancel each other out in each two longitudinally adjacent terminal elements, and the introduction of external forces into the terminal strip is prevented.

BRIEF DESCRIPTION OF THE DRAWING

A preferred embodiment of the invention will be explained in detail with reference to the accompanying drawing, in which.

DESCRIPTION OF THE PREFERRED EMBODIMENT

Figure 2:
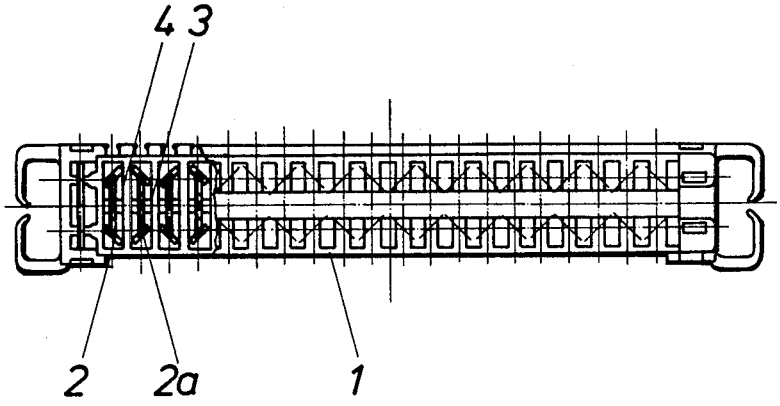
FIG. 2 is a plan view of a similar terminal strip including LSA-PLUS terminals adjacent ones of which are rotated by 180° relative to each other in accordance with the instant invention.

As will be apparent from FIG. 2, LSA-PLUS terminals 2, 2*a* are mounted in tandem in the longitudinal direction in terminal strip 1.

In order to prevent the torsional forces of the individual LSA-PLUS terminals created upon termination of the wires (not shown) from cumulatively acting in the same direction on the strip, every other U-shaped LSA-PLUS terminal 2*a* is mounted with an orientation of 180° from terminal 2. From FIGS. 2 and 4 it can be seen that each terminal, as mounted in the terminal strip, is oriented to form the mirror image of each adjacent terminal throughout the length of the terminal strip. Forces from longitudinal adjacent terminals 2, 2*a* thereby act in opposite directions and are thus not additive but cancel each other.

Figure 1:
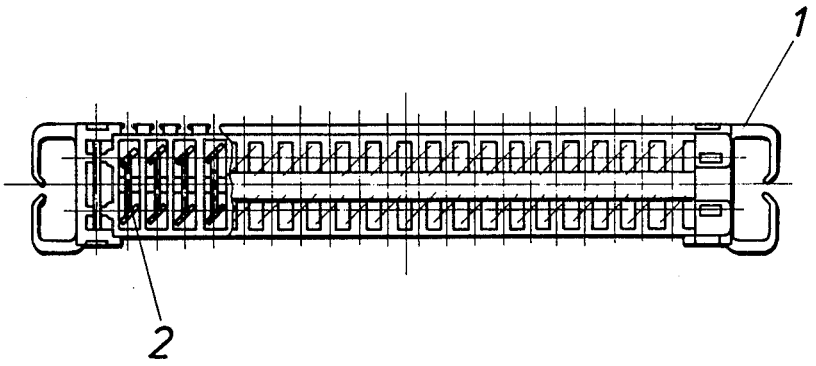
FIG. 1 is a plan view of a terminal strip including LSA-PLUS terminals mounted in a known arrangement.

FIG. 1 shows the terminal strip 1 including Z-shaped LSA-PLUS terminals 2 which are mounted in the conventional way.

Figure 3:
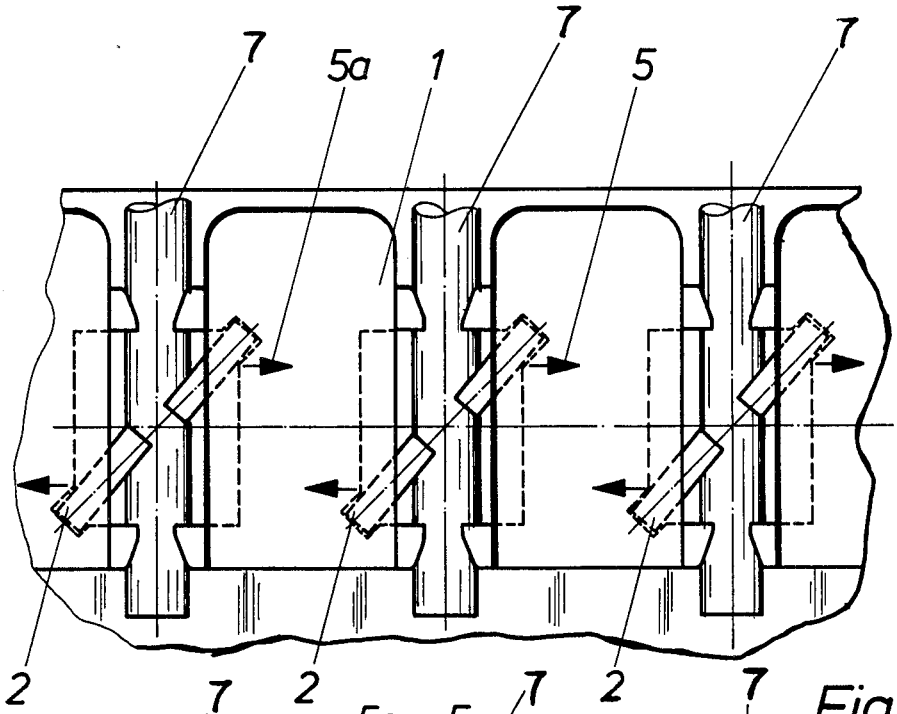
FIG. 3 shows the forces acting on the LSA-PLUS terminals when mounted in accordance with FIG. 1.

FIG. 3 shows that in case of conventional mounting of the LSA-PLUS terminals 2 the forces 5, 5*a* (arrows) due to termination of wires 7 by the terminal elements, will act in the same direction, thus additively applying external torque to the terminal strip. Of course, that torque must be countered by the apparatus to which the terminal strip is mounted or by the interconnecting means between them.

Figure 4:
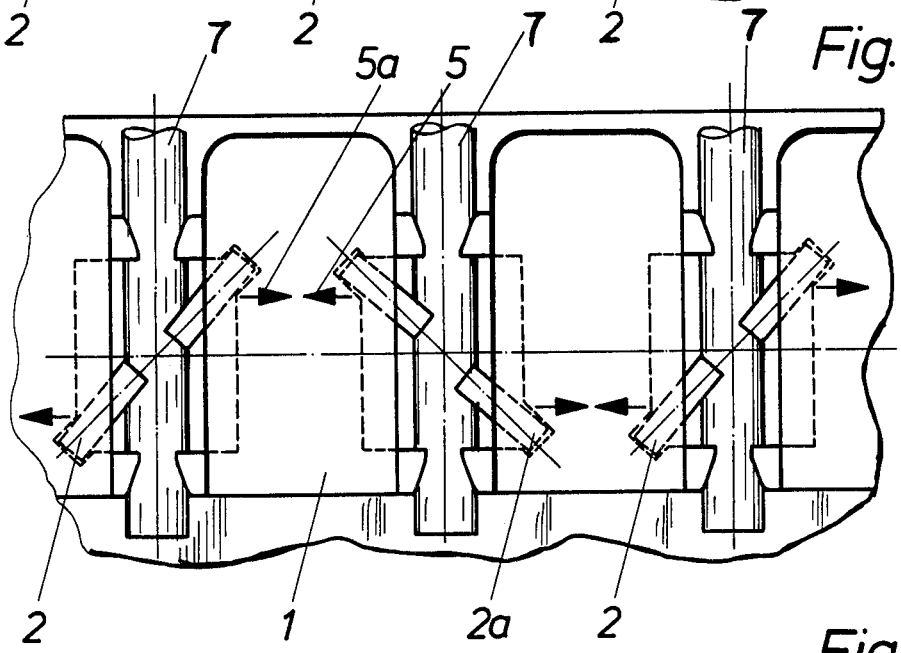
FIG. 4 shows the forces acting on the LSA-PLUS terminals when mounted in accordance with FIG. 2.

If, however, every other LSA-PLUS terminal 2*a* is rotated in accordance with the invention by 180°, as shown in FIG. 4, the forces 5, 5*a* (arrows) due to terminated wires 7 will act in opposite directions and thus cancel each other. With this arrangement the next external torsional force on the terminal strip due to the terminated wires is zero.

Figure 5:
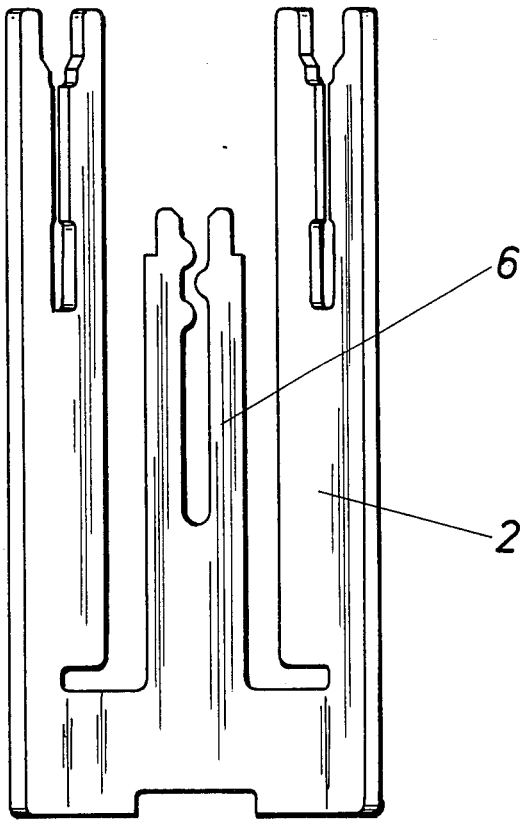
FIG. 5 is an enlarged depiction of a U-shaped LSA-PLUS terminal.

FIG. 5 shows the U-shaped LSA-PLUS terminal 2 used in accordance with the invention, including a tap 6 for an arrester magazine (not shown).

We claim:

1. Electrical terminal apparatus adapted to connect a plurality of insulated wires, said terminal apparatus comprising:

an elongated electrically insulative terminal strip;

a plurality of solderless, non-screwed and stripping-free terminal elements, each having a polytropic air gap;

a plurality of U-shaped terminal members, each said terminal member comprising two said terminal elements in spaced relationship;

said terminal strip being shaped and configured to receive and positively retain said terminal members in tandem in the longitudinal direction, each said terminal member being oriented at 180° relative to each adjacent similar member in said terminal strip so that each terminal member, as mounted in said terminal strip, is effectively a mirror image of each adjacent terminal member throughout the length of said terminal strip;

each said terminal element being formed of resilient, leaf-shaped contact material including a slot, the main portion of said slot adjoining an enlarged insertion opening and being defined by sharp edges, said slot being oriented at an angle of about 45° with respect to the longitudinal axis of said terminal strip and with respect to the axis of the wire being terminated and having a width that is smaller than the thickness of the metallic core of the wire so that when the wire is urged into the slot, the wire insulation is severed and a torquing contact is made between the wire and said terminal element;

whereby each two longitudinally adjacent terminal elements, when connecting a respective wire, exert a torque on said terminal strip of substantially equal magnitude and opposite direction so that the net external torque on said terminal strip due to connections to the wires is maintained at substantially zero.

* * * * *